United States Patent [19]

Crown et al.

[11] Patent Number: 4,732,418

[45] Date of Patent: Mar. 22, 1988

[54] KNOB LATCH

[75] Inventors: Marlin D. Crown, Sycamore; James A. Edeus, Rock Falls, both of Ill.

[73] Assignee: National Manufacturing, Sterling, Ill.

[21] Appl. No.: 831,259

[22] Filed: Feb. 20, 1986

Related U.S. Application Data

[63] Continuation of Ser. No. 533,554, Sep. 19, 1983, abandoned.

[51] Int. Cl.[4] ..... E05C 3/04

[52] U.S. Cl. ..... 292/207; 70/216; 70/478; 292/152

[58] Field of Search ..... 70/473, 224, 215, 216, 70/478, 484, 475, 485; 292/207, 147, 152, 60, 202, 208

[56] References Cited

U.S. PATENT DOCUMENTS

| | | | |
|---|---|---|---|
| 777,686 | 12/1904 | Moore et al. | 292/147 |
| 1,093,630 | 4/1914 | Kelly | 292/152 X |
| 2,620,213 | 12/1952 | Keeler | 292/152 X |
| 2,707,121 | 4/1955 | Behnke | 292/207 X |
| 2,851,871 | 9/1958 | Newell | 292/207 X |
| 2,873,990 | 2/1959 | Friedman et al. | 292/207 X |
| 2,929,651 | 3/1960 | Friedman et al. | 292/207 X |
| 3,159,994 | 12/1964 | Schulz | 292/207 X |
| 3,797,869 | 3/1974 | Shaw | 292/207 |
| 4,296,619 | 10/1981 | Widen | 70/451 |

FOREIGN PATENT DOCUMENTS

| | | | |
|---|---|---|---|
| 1017570 | 1/1966 | United Kingdom | 292/147 |

*Primary Examiner*—Lloyd A. Gall

*Attorney, Agent, or Firm*—Edmond T. Patnaude

[57] ABSTRACT

A door latch employs removable standoff posts in a concealed mounting, and a lockable latching mechanism which includes a locking slide manually actuatable from the inside of the door and movable from the locked to the unlocked position by a rotary cam member connected to a key-operated lock cylinder on the outside of the door with a forked one-piece operator shaft spanning the rotary cam member to interconnect the inside handle and the outside knob.

8 Claims, 4 Drawing Figures

KNOB LATCH

This is a continuation of application Ser. No. 533,554, filed Sept. 19, 1983, now abandoned.

SPECIFICATION

The present invention relates in general to latches of the type commonly used on storm doors, and it relates in particular to a new and improved latch having removable standoff posts for mounting the latch in a plurality of previously drilled mounting hole configurations, a novel locking slide and key operated cam operator for moving the locking slide to its unlocked position, and a one-piece operator shaft.

BACKGROUND OF THE INVENTION

Storm door and screen door latches are generally mounted to the associated doors by means of screws which extend through aligned holes in the door and in the inside and outside latch cases, which holes are usually located on one and three-quarter inch centers or on three inch centers. Different length screws have been used with different door thicknesses. It would, therefore, be desirable to provide a door latch having a universal mounting arrangement enabling its use with either type of predrilled door as well as with various door thicknesses.

Many different mechanisms are known in the prior art door latches to be operated from both the inside and outside of the door as well as for locking the latch in the latched condition. Such prior art mechanisms are, however, relatively complex and expensive to manufacture, wherefor it would be desirable to provide a simpler and more durable latch mechanism for use with screen doors and with storm doors.

SUMMARY OF THE INVENTION

Briefly, there is provided in accordance with the present invention a new and improved latch which includes inner and outer cases mountable on the inside and outside of a door by standoff posts removably mounted to one of the cases. A first handle having an integral dog thereon is rotatably mounted to the inner case, and a second handle in the form of a knob is rotatably mounted to the outer case. The handles are interconnected by an operator shaft extending through the door shaft whereby either handle can be rotated to rotate the dog on the inside one of the handles out of latching engagement with a strike mounted on the associated door frame.

A locking member is slidably carried by the first case for manual movement between a locked position wherein it blocks rotation of the operator shaft and an unlocked position out of engagement with the operator shaft. The operator shaft is tubular, and a key lock spindle extends therethrough and has a cam operator near one end for camming the locking member out of its locking position in response to rotation of a key operated lock cylinder.

In accordance with another aspect of the invention a leaf type detent spring is carried by the locking member and has two, mutually parallel leaves which prevent the locking member from being spuriously moved out of either the locked or unlocked position.

GENERAL DESCRIPTION OF THE DRAWING

The present invention will be better understood by a reading of the following detailed description taken in conjunction with the accompanying drawings wherein.

DETAILED DESCRIPTION OF A PREFERRED EMBODIMENT OF THE INVENTION

Figure 3:
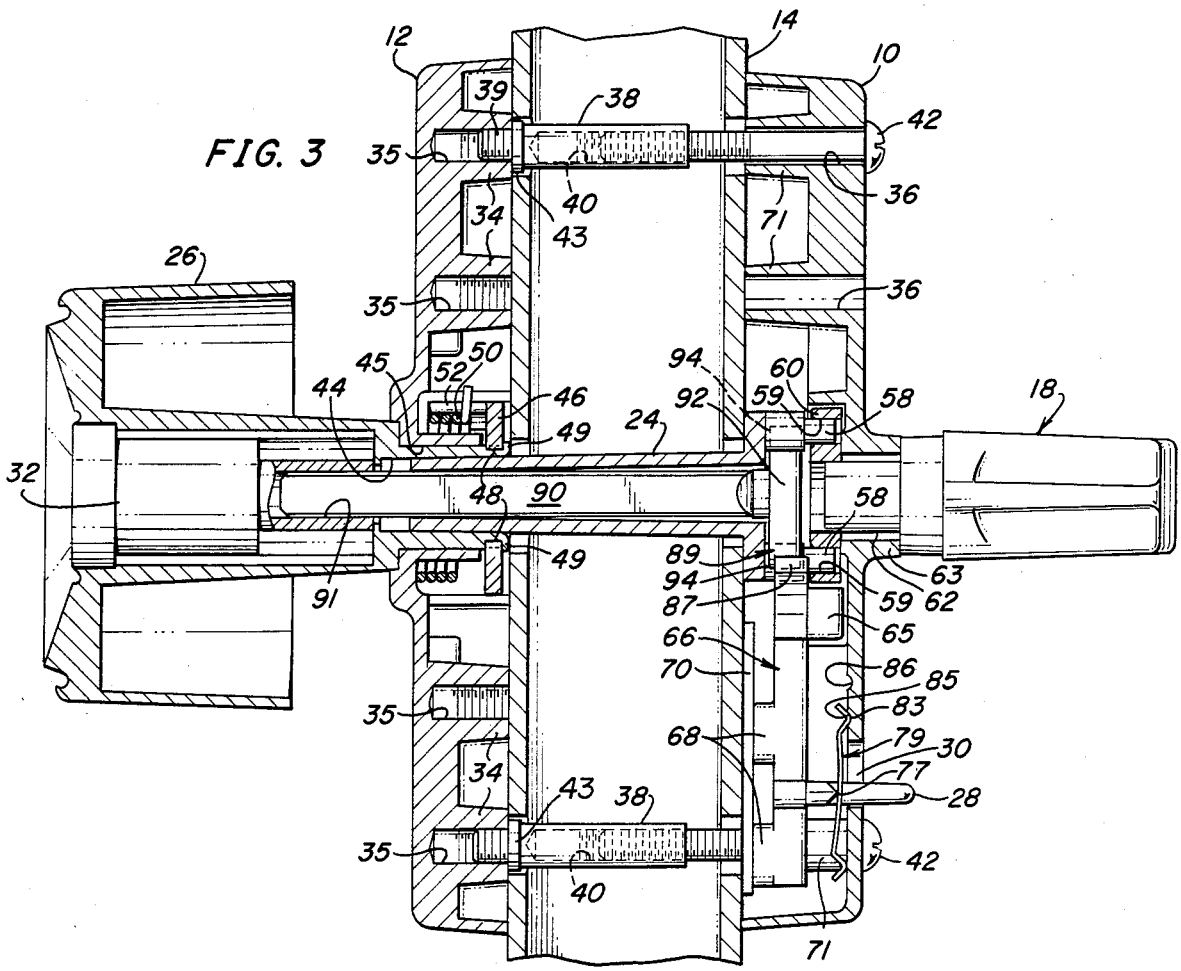
FIG. 3 is a cross-sectional view taken along the line 3—3 of FIG. 2.

A latch for use with screen doors, storm doors and the like may be seen to include an inside case member 10 and an outside case member 12. The case members are adapted to be mounted directly opposite to one another on the inside and outside faces, respectively, of an associated door 14 in the manner as shown in FIG. 3. The case members are mounted in proximity to the outer edge of the door 14 so that a dog 16 on the inside handle 18 engages a conventional strike bar 20 suitably mounted to the door frame 22 in association with which the door 14 is mounted. The inside handle 18 is rotatably mounted in the case member 10, and as more fully described hereinafter, is connected by a main operating shaft 24 to an outside handle in the form of a knob 26. The inside and outside handles cannot be rotated relative to one another, wherefor either handle can be manually rotated to rotate the dog 16 out of latching engagement with the strike bar 20 to unlatch the door.

Figure 1:
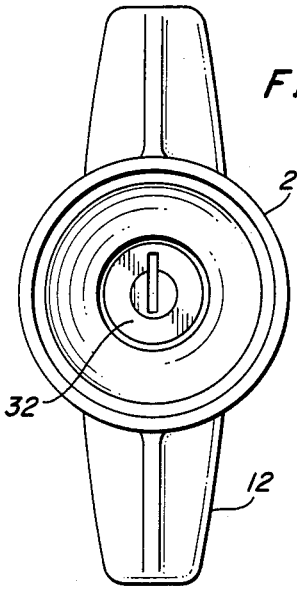
FIG. 1 is an elevational view of a latch embodying the invention, the latch being viewed from the outside of the door to which it is mounted.
Figure 2:
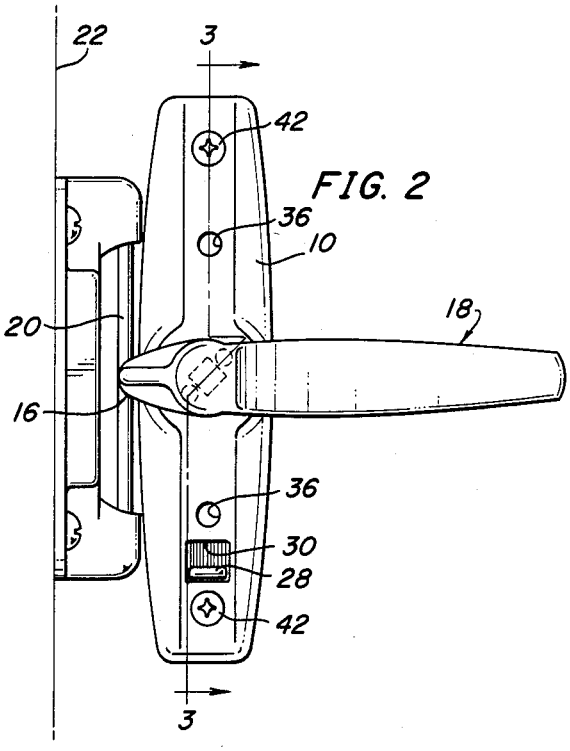
FIG. 2 is an elevational view of the latch of FIG. 1 as viewed from the inside of the door, the latch being shown in operative engagement with an associated strike.

As best shown in FIG. 2, a finger actuator lug 28 projects through an opening 30 in the inside case member 10 and may be manually moved between a locked position wherein rotation of the handles is prevented and an unlocked position wherein the handles may be rotated to unlatch the associated door. A key operated lock cylinder 32 is rotatably mounted on the outside handle 26, and as more fully described hereinafter, can be used to unlock the latching mechanism from the outside of the door.

Figure 4:
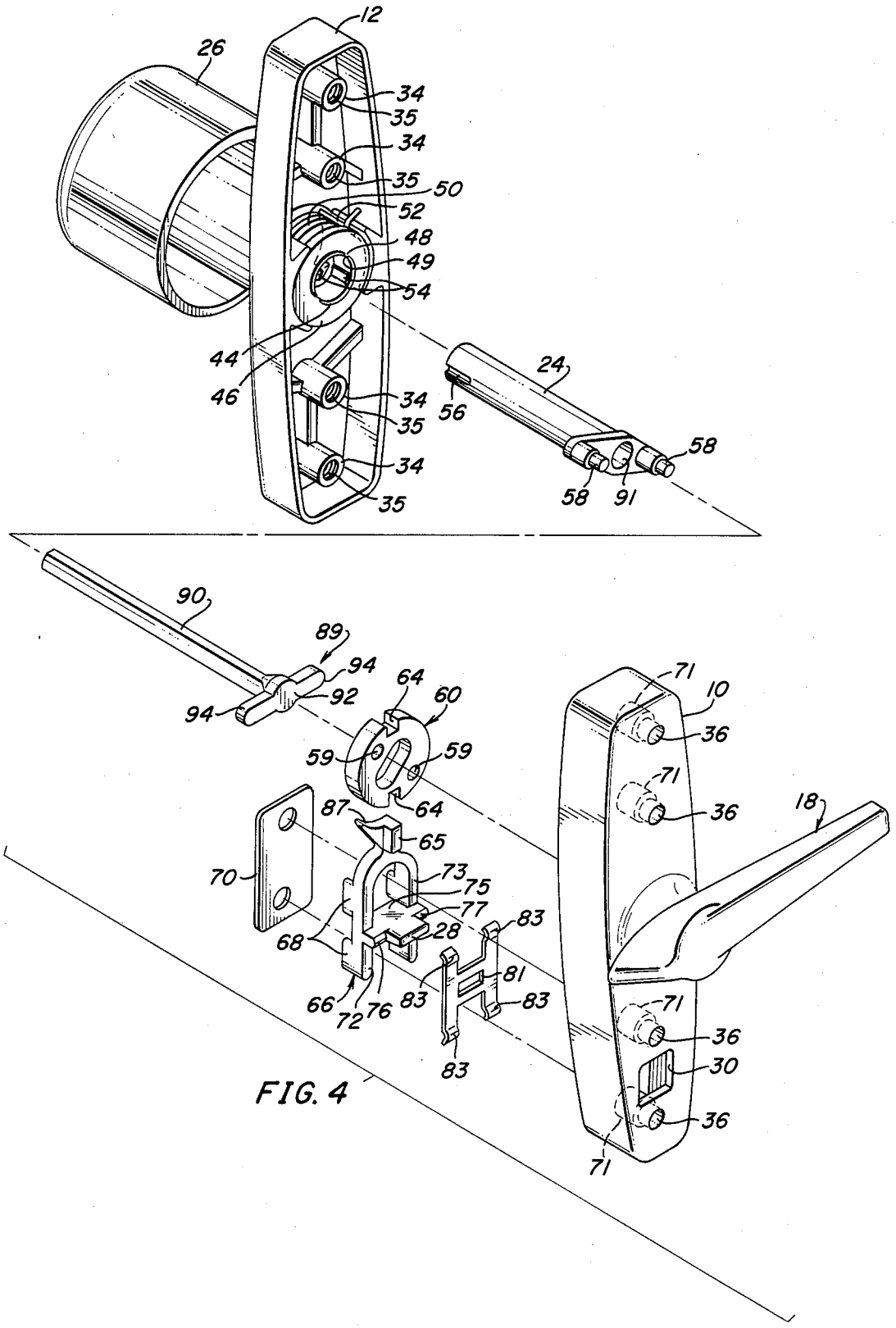
FIG. 4 is an exploded perspective view of the latch shown in FIGS. 1, 2 and 3.

Considered in greater detail and with particular reference to FIGS. 3 and 4, it may be seen that the outside case member 12 has four mounting posts 34 provided respectively with internally opening threaded, blind holes 35 axially aligned with a plurality of holes 36 which extend through the inside case member 10. Two mounting posts 38 are provided and each has an externally threaded end 39 and an internally threaded opposite end which receives one of a pair of mounting screws 42. The posts 38 are provided with external locating flanges 43 which respectively abut the ends of the posts 34 in the completed assembly.

As may be seen in FIG. 3, the knob 26 has an elongated, tubular hub 44 which extends through an integral bushing portion 45 of the outside case member 12. A control washer 46 has internal lugs 48 which fit into longitudinally extending grooves 49 in the end portion of the hub 44 to non-rotatably connect the washer 46 to the knob 26. The washer 46 is suitably affixed, as by staking, to the hub 44. A coil spring 50 surrounds the hub 44 on the inside of the case member 12 with the respective ends of the spring bearing against the case member 12 and the washer 46. The spring 50 exerts a torque on the knob 26 to resiliently bias the handle 18 into the strike engaging latch position shown in FIG. 2.

With particular reference to FIG. 4, it may be seen that the hub 44 is tubular and has two diametrically opposed longitudinal ribs 54 which are received in complementary grooves 56 in the end portion of the operating shaft 24 when the outside end of the shaft is positioned within the hub 44 as shown in FIG. 3. The other end of the shaft 24 is provided with a pair of longitudinally extending pins 58 which respectively fit into a pair of holes 59 in a locking ring 60 which is fixedly and non-rotatably secured to the handle 18. The handle 18 has a hub portion 62 which extends through an integral bushing sleeve portion 63 of the inside case member 10. The ring 60 has a non-circular central opening which fits over the complimentary shaped hub 62, and may be secured in place in a conventional staking operation. The ring 60 is thus part of the linkage connecting the inside and outside handles together, and furthermore, it holds the handle 18 and the case member 10 in mutually assembled relationship.

In accordance with an important aspect of the present invention, the locking ring 60 is provided with a pair of diametrically opposed notches 64 into one or the other of which a blocking lug 65 on a slidable locking member 66 may be positioned to prevent rotation of the handle 18 out of the latched position. The locking member 66 is provided with two pairs of longitudinally extending lugs 68 which slidably abut a retainer plate 70 which receives the end portions of a plurality of mounting posts 71 on the case member 10. The ends of these mounting posts 71 are peened over to secure the retainer plate 70 in place. The locking member 66 includes a pair of spaced, parallel legs 72, 73 which are bridged by a crossarm 75 having the actuator lug 28 extending therefrom. Integral with the crossarm 75 are a pair of fulcrum surfaces 76 and 77 on which a generally H-shaped detent spring 79 is pivotably supported. The spring 79 has a central slot 81 through which the lug 28 loosely extends. The spring 79 can be seen to include four raised surfaces 83 near the respective ends of the four leaf spring arms, with the raised surfaces 83 at the top of the spring 79 being adapted to depend into one or the other of a pair of detent, grooved recesses 85 and 86 in the case 10 as best shown in FIG. 3. With the raised surfaces 83 in the lower recesses 85, the locking member 66 is retained in the unlocked position with the lug 65 disengaged from the locking ring 60. With the raised surfaces 83 in the upper recesses 86 the locking member 66 is retained in the locking position with the lug 65 extending into one of the notches 64 in the locking ring 60.

In order to permit unlocking of the latch from the outside of the door, an eccentric cam surface 87 is provided on the locking member 66 adjacent to the lug 65, and a cam operator 89 is non-rotatably connected to the lock cylinder 32 by an integral spindle section 90 which extends through the tubular operator shaft 24. The spindle 90 is non-circular in cross-section and the end thereof fits into a complimentary hole 91 in the key lock cylinder 32. The cam operator 89 includes an arm 92 located between the pins 58. When the locking member is disposed in the locking position, rotation of the key lock cylinder 32 rotates the cam operator 89 whereby one of its two cam operator surfaces 94 engage the cam surface 87 and pushes the locking member to its lowermost position wherein the lug 65 is disengaged from the notch 64 thereby permitting rotation of the handle 18 out of the latched position.

The present invention may thus be seen to provide a novel latch which is adapted to be used with either left-hand or right-hand swinging doors, and which may be mounted to doors in which mounting holes have been drilled at a plurality of different possible locations.

While the present invention has been described in connection with a particular embodiment of the invention, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A door latch, comprising in combination:

a first case adapted to be mounted to one side of a door, a second case adapted to be mounted to the other side of said door at a location opposite to said first case, a first latch handle rotatably mounted in said first case and having a strike engagable latch surface thereon, a second latch handle rotatably mounted in said second case, an operating shaft having a first end non-rotatably connected to said second handle and having a second end, locking means slidably mounted to one of said cases for movement between a locking position which prevents rotation of said shaft and an unlocking position which permits rotation of said shaft, said locking means having a cam surface thereon, a keylock spindle concentric with said operating shaft, said spindle having an integrally-formed T-shaped end portion, a cam operator surface means on said end portion for moving said locking means from said locking position to said unlocking position in response to rotation of said spindle, key operated means rotatably carried by said second latch handle and non-rotatably connected to said spindle for rotating said spindle to unlock said latch, a locking ring within said first case non-rotatably connected to said first handle, said locking ring having a pair of diametrically opposed holes provided therein, said T-shaped end portion of said spindle disposed between said second end of said operating shaft and said locking ring, a pair of pins integral with said operating shaft in mutual parallel relationship therewith and extending into said holes of said locking ring, and said cam operator surface means being disposed radially outward from the circle defined by the path of rotation of said pins, whereby when said latch is assembled to a door said pins and holes cooperate to prevent relative rotation between said second handle and said first handle.

2. A door latch according to claim 1 wherein said operating shaft is tubular, and said keylock spindle extends through said operating shaft.

3. A door latch according to claim 2 wherein said cam operator surface means comprises two cam operator surfaces disposed 180 degrees apart relative to the longitudinal axis of said shaft.

4. A door latch according to claim 3 comprising detent spring means carried by said locking means for removably locking said locking means in each of said locking and unlocking positions.

5. A door latch according to claim 4 wherein said locking means is provided with an actuator lug which extends through a hole in said detent spring means and an elongated hole through said first case.

6. A door latch according to claim 5 wherein said detent spring means is generally H-shaped, and said hole is centrally disposed in said detent spring means.

7. A door latch according to claim 6 wherein said detent spring means has a plurality of leaf spring arms each having a laterally extending detent portion positionable in either of two detent recesses in said first case.

8. A door latch according to claim 6 wherein said T-shaped end portion of said spindle is cooperable with said pins to rotate said first latch handle of said latch.

* * * * *